US006676588B2

(12) United States Patent
Herda et al.

(10) Patent No.: US 6,676,588 B2
(45) Date of Patent: Jan. 13, 2004

(54) AUTOMATICALLY CLOSING SURFACE ELEMENT AT THE PERIPHERY OF CYLINDERS

(75) Inventors: Philippe Francois Herda, Nogent sur Oise (FR); Serge Lanvin, Cires les Mello (FR); Thierry Vauchelle, Ravenel (FR); Yannis Woloch, Bourges (FR)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/050,646

(22) Filed: Jan. 16, 2002

(65) Prior Publication Data

US 2002/0132716 A1 Sep. 19, 2002

(30) Foreign Application Priority Data

Jan. 23, 2001 (DE) ..... 101 02 808

(51) Int. Cl.[7] ..... B31F 7/00
(52) U.S. Cl. ..... 493/359; 493/478; 493/479
(58) Field of Search ..... 493/478, 479, 493/475, 476, 356, 405, 359; 83/346, 698.21, 698.41, 954

(56) References Cited

U.S. PATENT DOCUMENTS

| | | | | | |
|---|---|---|---|---|---|
| 1,964,513 | A | * | 6/1934 | Hammer | 220/254.2 |
| 2,335,431 | A | * | 11/1943 | Meyer | 270/43 |
| 2,435,881 | A | * | 2/1948 | Faeber | 493/30 |
| 2,800,244 | A | * | 7/1957 | Witt | 220/254.5 |
| 3,749,274 | A | * | 7/1973 | Mele et al. | 220/825 |
| 3,978,616 | A | * | 9/1976 | Pennock | 49/386 |
| 4,210,797 | A | * | 7/1980 | Tomaro | 219/225 |
| 4,260,070 | A | * | 4/1981 | Pierson | 43/55 |
| 4,845,886 | A | * | 7/1989 | Robinson | 43/55 |
| 4,870,778 | A | * | 10/1989 | Sheppard | 43/55 |
| 5,029,829 | A | | 7/1991 | von Hein et al. | 270/47 |
| 5,039,076 | A | | 8/1991 | Fischer | 270/47 |
| 5,156,291 | A | * | 10/1992 | Mielke | 220/254.5 |
| 5,429,578 | A | | 7/1995 | Calbrix et al. | 493/359 |
| 5,571,069 | A | * | 11/1996 | Shah | 493/357 |
| 5,941,016 | A | * | 8/1999 | Welcher | 43/55 |
| 6,071,224 | A | | 6/2000 | Lanvin et al. | 493/422 |

FOREIGN PATENT DOCUMENTS

| | | |
|---|---|---|
| DE | 2011661 | 7/1971 |
| DE | 3831182 | 8/1990 |
| DE | 3906975 | 9/1990 |
| DE | 4335048 | 4/1994 |
| DE | 19721913 | 2/1998 |

* cited by examiner

*Primary Examiner*—Rinaldi I. Rada
*Assistant Examiner*—Paul R Durand
(74) *Attorney, Agent, or Firm*—Davidson, Davidson & Kappel, LLC

(57) ABSTRACT

The present invention relates to a copy-carrying cylinder which has a peripheral surface (2) supporting sheet-like copies and which is provided with retaining elements for fixing the sheet-like copies in place on the peripheral surface (2). A folding device (5) which can be moved into and out of openings (4) at the peripheral surface (2) are bounded by at least one movable surface element (13). The surface element (13, 13.3) which is associated with the folding device (5) is designed in such a manner that it takes its closed position (22) automatically.

12 Claims, 2 Drawing Sheets

AUTOMATICALLY CLOSING SURFACE ELEMENT AT THE PERIPHERY OF CYLINDERS

Priority to German Patent Application No. 101 02 808.3, which is incorporated-by-reference herein, is hereby claimed.

BACKGROUND INFORMATION

The present invention relates to an automatically closing surface element at the periphery of cylinders, for example, at the periphery of copy-carrying folding cylinders in folding apparatuses.

U.S. Pat. No. 5,429,578 relates to a folding apparatus for a rotary printing press. In a folding apparatus for cutting and folding continuous material webs from which folded copies are cut off are included a cutting cylinder and a transfer cylinder cooperating therewith. The transfer cylinder is driven and, moreover, cooperates with a folding jaw cylinder. The transfer cylinder includes an outer surface at which a number of sets of impaling pins and folding blades are accommodated which push the copies that are cut off from the continuous material web into folding jaws. The transfer cylinder is designed in such a manner that the rotational position between the sets of impaling pins and the folding blades can be varied. In the region of the outer surface of the transfer cylinder, moreover, a set of closing surfaces are accommodated on each side of a folding blade and of a set of impaling pins, the closing surfaces moving relative to each other in such a manner that they overlap one another, thus forming a virtually continuously closed outer lateral cylinder surface, independently of the rotational position of the sets of impaling pins and of the folding blades on the copy-carrying cylinder with respect to each other.

U.S. Pat. No. 6,071,224 discloses a copy-carrying cylinder having guides for extensible folding elements. The copy-carrying cylinder provided in a copy-processing machine includes two opposing and cooperating cylinders receiving copies on their peripheral surfaces. The copies which are retained on the peripheral surface of one of the cylinders are conveyed by an extensible folding device into receiving elements at the peripheral surface of the other cylinder. At the peripheral surface of one of the cylinders, provision is made for covers bounding an opening through which a folding device, which is accommodated in a hollow space in the interior of the cylinder, moves in and out.

The design approaches known from the related art indeed limit the opening at the peripheral surface of a copy-carrying cylinder in the region of a folding device which move in and out but can be accessed only with considerable effort from the lateral surface of the folding cylinders which are difficult to access anyway, for example, for replacing a worn out folding device such as sets of impaling pins or folding blades.

SUMMARY OF THE INVENTION

In view of the indicated related art, an object of the present invention is, on one hand, to maintain an as continuous as possible peripheral surface on copy-carrying cylinders and, on the other hand, to provide an easy way to access folding devices which are supported in the interior of the cylinder.

The present invention provides a copy-carrying cylinder having a peripheral surface (2) for carrying sheet-like copies which can be acted upon by a folding device (5) which is used for producing a fold and which can be moved out of an opening (4) in the cylinder (1). A movable surface element (13) is associated with opening (4), wherein the surface element (13, 13.3) is designed and arranged near the folding device (5) in such a manner that, via the application of a pressure force, it can be moved into an open position in which it enables access to the folding device (5), and that it automatically moves from the open position into a closed position subsequent to canceling the pressure force.

The advantages which can be attained using the design approach according to the present invention are to be seen above all in that it allows the clearance next to a retractable and extensible folding device at the peripheral surface of copy-carrying cylinders to be closed so that a virtually continuous lateral cylinder surface ensues. Corners are prevented from being turned down during the transfer of the sheet-like copies from the peripheral surface of a copy-carrying cylinder to the peripheral surface of another copy-carrying cylinder cooperating therewith. Besides, the arrangement of a pivoted surface element proposed according to the present invention offers the possibility of easy access to the fastening elements for a folding device in a hollow space provided underneath the lateral surface of a copy-carrying cylinder. The closing of the pivoted surface element is assisted by the centrifugal force acting upon the hinged surface element during the operation of the copy-carrying cylinder. The surface element can be swiveled open in an easy and simple manner using a tool, for example, a wrench so that there is immediate access to fastening elements for a folding device such as impaling pin bearing arrangements or folding blades or the like.

In an advantageous embodiment of the basic idea of the present invention, the surface element can have a one-part or also a multipart design. If the hinged surface element is designed in one piece, it acts as a guide surface for tools to be introduced into the hollow space underneath the peripheral surface of the copy-carrying cylinder; if the surface element has a multipart design, a hinged segment of the surface element can be adapted in optimum manner to the tool to be introduced into the hollow space underneath the peripheral surface.

The surface element can be advantageously accommodated on a wall bounding the opening in the peripheral surface of the cylinder. The cylinder can be provided, for example, with a hinge bearing which supports the surface element more or less centrically and which allows the hinged surface element to deflect from a closed position (operation) into an open position (maintenance work).

At the hinge bearing, the surface element can be moved about a swivel pin which can have a spring element associated therewith.

In a first variant of an embodiment, the spring element can be designed as a spiral spring which surrounds the swivel pin and whose free legs, on one side, are braced against the lower side of the surface element which is deflectable about the swivel pin and, on the other side, are braced against a wall which bounds the hollow space underneath the lateral cylinder surface. Besides, it is possible for the spring element to be designed as a pressure spring which can be articulated both to the hinge bearing of the surface element and to the lower side of the surface element.

In the one-part embodiment of the hinged surface element, the hinged surface element can be provided with a contact surface over the opening for the retractable and extensible folding device, the contact surface plunging into a recess provided at the peripheral surface of the copy-carrying cylinder, when in the closed position. In this variant of an embodiment, the surface element, when in its closed position (operation), forms a virtually continuous surface with the adjacent region of the lateral cylinder surface.

In another variant of an embodiment of the surface element proposed according to the present invention, it is possible for the surface element to have a multipart design, i.e., provision is made for a hinged segment and a stationary segment of a surface element. The hinged segment of the surface element can be put against the wall of the hollow space underneath the lateral cylinder surface in a spring-loaded manner by introducing a tool, while the stationary segment remains in its position. According to this variant of an embodiment, the size of the hinged segment of the surface element can advantageously be adapted to the maximum size of a tool to be introduced into the hollow space underneath the lateral cylinder surface.

Using the design approach proposed according to the present invention, the accessibility of fastening elements in hollow spaces of cylinders as, for example, copy-carrying cylinders in folding apparatuses or rotary printing presses is considerably simplified. A removal of the cylinders for maintenance work can be avoided, permitting a drastic reduction of down times of folding apparatuses and rotary printing presses cooperating therewith for carrying out maintenance work. Via the action of centrifugal force during the rotation of the cylinders, it is ensured that the pivoted surface elements or segments of the surface elements always take their closed position while the copy-carrying cylinders are in operation, resulting in a virtually continuous peripheral surface of the copy-carrying cylinders designed according to the present invention during the operation thereof.

BRIEF DESCRIPTION OF THE DRAWINGS

In the following, the present invention will be explained in detail with reference to the drawings, in which.

DETAILED DESCRIPTION

Figure 1:
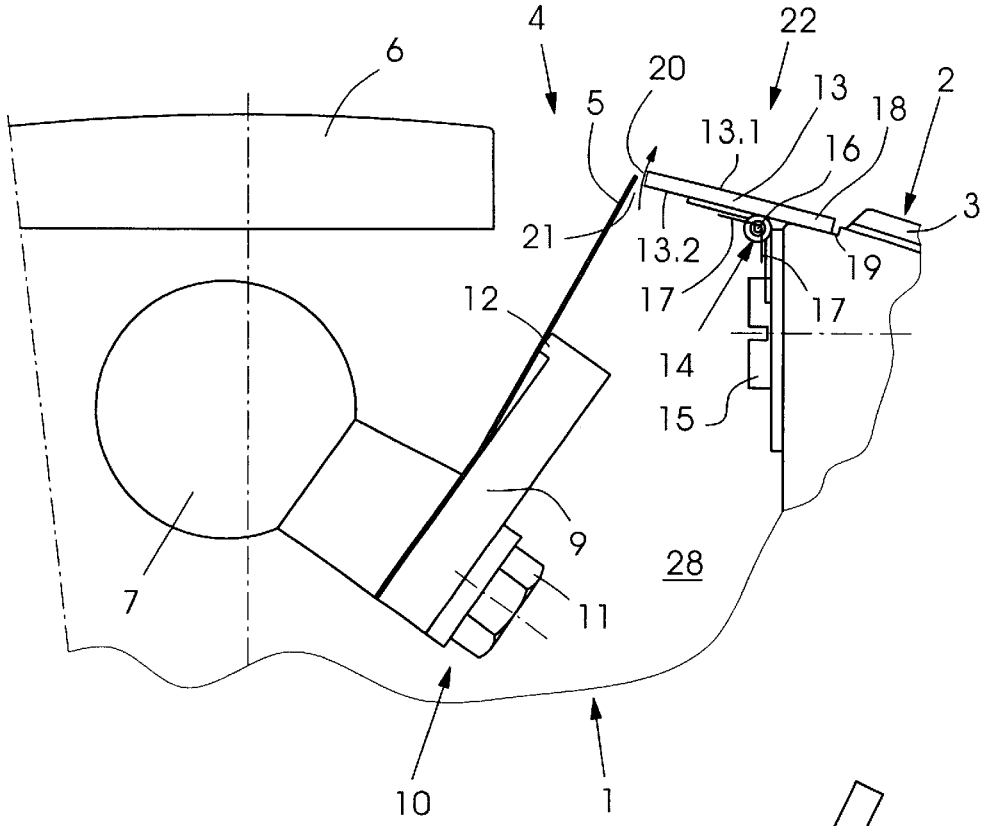
FIG. 1 shows a surface element which is associated with a retractable and extensible folding device and takes its closed position automatically.

A surface element which automatically takes its closed position and is associated with an extensible folding device such as a folding blade is shown in FIG. 1.

A cylinder 1, for example, a copy-carrying cylinder in a folding apparatus (folding blade cylinder) is provided with an opening 4 in which is accommodated a retractable and extendible folding device 5. On a lateral cylinder surface 2 of cylinder 1 are carried copies to be folded which are cut off from a continuous material web and which are pushed by retractable and extensible folding device 5 into folding jaws of a folding jaw cylinder (not shown here) cooperating with cylinder 1 according to the representation in FIG. 1.

Folding device 5 schematically shown in FIG. 1 as defined herein can both folding blades and impaling pins or the like, which are cyclically retracted into lateral cylinder surface 2 and cyclically extended out therefrom again for pushing copies into open folding jaws. To carry the copies on lateral cylinder surface 2 in a careful manner, the lateral cylinder surface can be provided with an elastic surface coating 3.

Cyclically retractable and extensible folding device 5 can be supported on a swivel axle 7, a spacer 8 being provided between swivel axle 7 and a receptacle 9. Between spacer 8 and receptacle 9 for a folding device 5, the folding device is clamped with its lower region via a clamping screw 10. To slacken or tighten screw 10, which is necessary for replacing folding device 5, screw head 11 of clamping screw 10 must be accessible. Swivel axle 7, spacer 8, receptacle 9 for folding device 5 are accommodated in an interior space 28 underneath a cover 6 covering swivel axle 7 and underneath a pivoted surface element.

According to the representation in FIG. 1, surface element 13 is formed in one piece. It supports itself on a hinge bearing 14, 16 which is fastened via a screw connection 15 to the side wall of an inner wall bounding interior space 28 inside of cylinder 1. Surface element 13 is accommodated off-center on hinge bearing 14 and is able to swivel about a swivel pin 16 provided on hinge bearing 14. Moreover, swivel pin 16 accommodates a spring element 17 which is preferably designed as a spiral spring. The free legs of the spiral spring are braced against lower side 13.2 of surface element 13 on one side and, on the other side, against a wall of interior space 28 at bearing 14. The upper side of surface element 13, which is depicted in its closed position 22, is denoted by reference numeral 13.1. In this position, a contact area 18 lying beyond opening 4 for the retractable and extensible folding device 5 plunges into a recess 19 provided in the wall which bounds interior space 28. In closed position 22, the end of surface element 13 facing retractable and extensible folding device 5 has a distance 21 from the tip of folding device 5 which is shown here in the retracted position. Closed position 22 represented in FIG. 1 corresponds to the operating position of surface element 13 which, on one hand, is forced into its closed position 22 by the spring force applied via spiral spring 17, the spring force being assisted during operation by centrifugal forces 20 developing during the rotation of the copy-carrying cylinder. The limit position of surface element 13 in its closed position 22 is constituted by the contact of contact area 18 with the upper side of recess 19.

Figure 2:
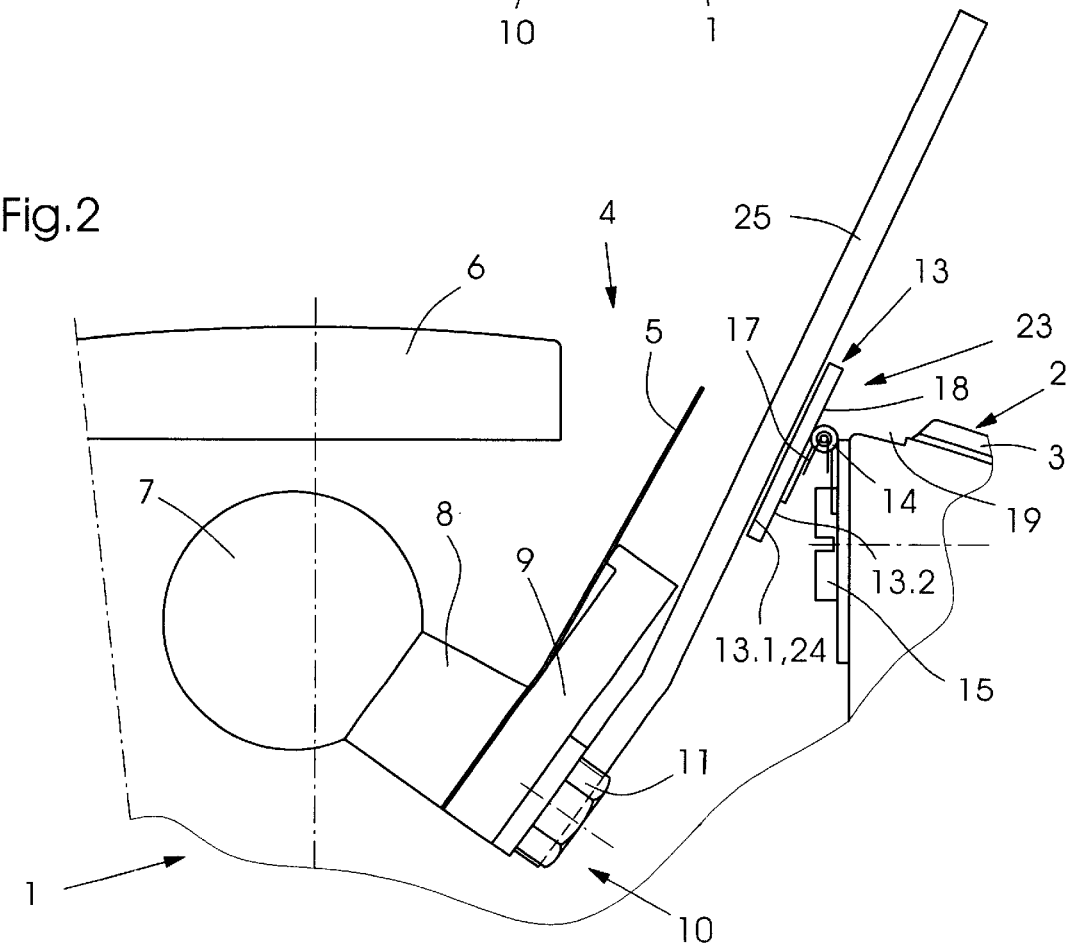
FIG. 2 depicts the surface element according to the representation in FIG. 1 in its open position with a tool introduced into the interior of a copy-carrying cylinder.

Discernible in FIG. 2 is the surface element according to FIG. 1 in its open position with the tool plunging into the interior of the copy-carrying cylinder.

During a standstill of copy-carrying cylinder 1 and for carrying out maintenance work such as the replacement of folding device 5 accommodated on receptacle 9, a tool 25, for example a wrench, is introduced into interior space 28 of cylinder 1. To this end, tool 25 is introduced into interior space 28 along upper side 13.1 of pivoted surface element 13. In its open position 23, surface element 13 takes the position shown in FIG. 2, upper side 13.1 of pivoted surface element 13 serving as a guide slope for tool 25 to be introduced. According to FIG. 2 when surface element 13 is in open position 23, the legs of spiral spring 17 are pressed together, biasing surface element 13. A free leg of spiral spring 17 is braced against lower side 13.2 of surface element 13 while the other leg of spiral spring 17 lies against hinge bearing 14, 16. In open position 23, contact area 18 facing away from opening 4 has moved out of recess 19 which constitutes the limit stop for closed position 22 shown in FIG. 1 of one-piece surface element 13 supported on hinge bearing 14, 16. Introduced tool 25 can now be engaged onto screw head 11 of clamping screw 10 and moved in a direction perpendicular to the to the drawing plane. Surface elements 13 can be flat surfaces extending over the width of a copy-carrying cylinder in opening region 4; however, surface elements 13 can also be positioned in the region of each clamping screw 10 for fastening a folding device 5 in such a manner that they are arranged side by side at a distance from each other over the width of copy-carrying cylinder 1.

Figure 3:
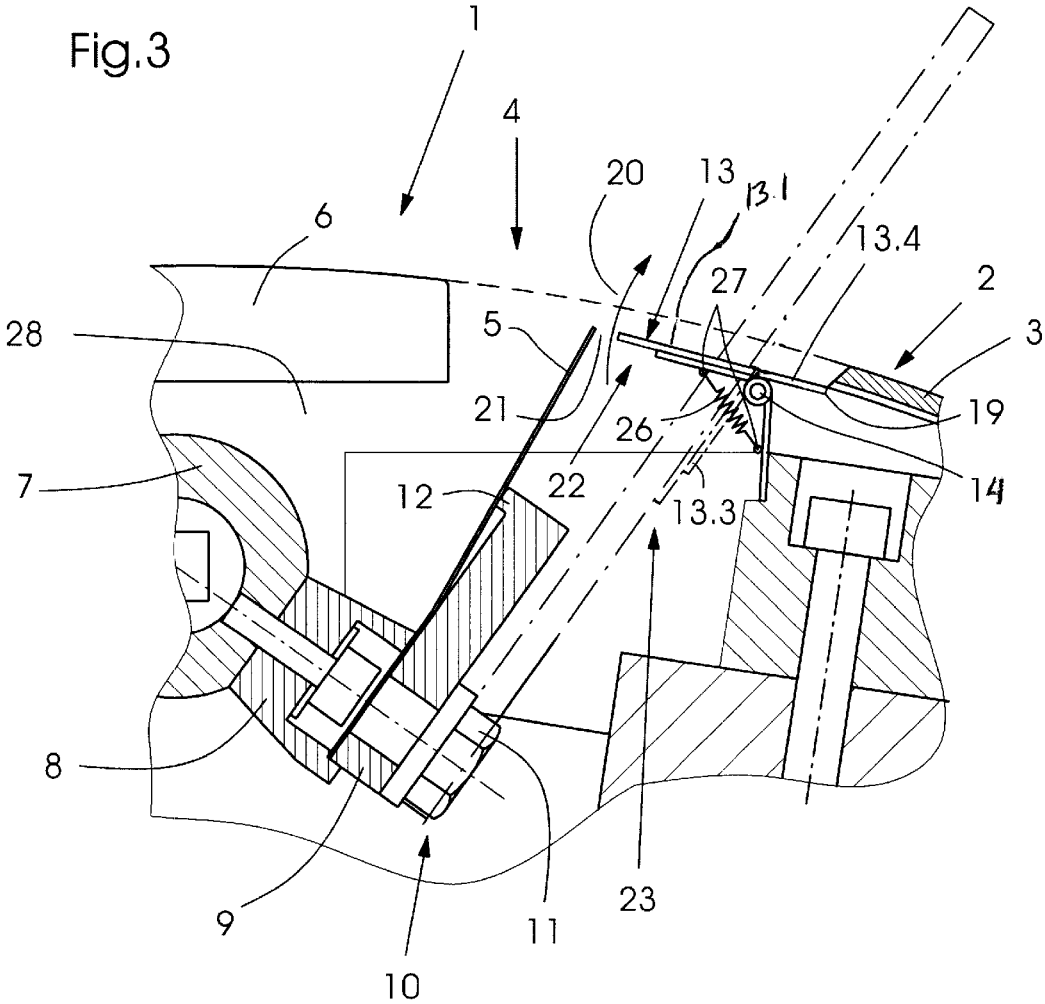
FIG. 3 represents an alternative variant of an embodiment of a surface element which is divided into two parts.

FIG. 3 represents an alternative variant of an embodiment of a surface element which is divided into two parts.

It can be seen in FIG. 3 that a surface element 13 can include both a stationary part 13.4 inserted in recess 19 in the region of lateral cylinder surface 2 and a segment 13.3 which can swivel about a swivel pin 14. When tool 25, which is shown here in dashed representation, is introduced into interior space 28 of cylinder 1, pivoted segment 13.3 of a multipart surface element 13 swings out of the way into interior space 28 against the action of a spring element 26. Upper side 13.1 of hinged segment 13.3 of the surface element acts as a guide slope for introducing tool 25 and for engaging it onto screw head 11 of clamping screw 10. While hinged segment 13.3 of surface element 13 swings down into interior space 28 of cylinder 1, spring element 26 is compressed. Spring element 26 can be designed as a tension-compression spring which can be articulated to the cylinder on one side and which can be articulated with its opposite end to the lower side of hinged segment 13.3 of surface element 13 at articulation points 27. Subsequent to tightening clamping screw 10 and removing tool 25 from interior space 28 of the cylinder, hinged segment 13.3 of multipart surface element 13 swings from its open position 23 into its closed position 22.

This movement is assisted by the tension release of spring element 26 which is articulated to the lower side of hinged segment 13.3 and to the cylinder 1 at articulation points 27. When multipart surface element 13.3, 13.4 is in its closed position 22, the distance identified by reference numeral 21 ensues between the leading edge of hinged segment 13.3 and the tip of folding device 5 retracted into interior space 28. In the preferred embodiment of the present invention, swivel pin 14 of surface element 13 is preferably arranged in such a manner that centrifugal forces 20 resulting from the rotation of the cylinder will not cause the leading edge of the hinged segment to be deflected out of the periphery of cylinder 1. In other words, swivel pin 14 of surface element 13 is arranged offset from the center of mass of surface element 13 at a distance in such a manner that surface element 13.3 is automatically moved into the closed position and retained therein by the centrifugal forces during a rotation of cylinder 1. This results in the advantage that only a comparatively small spring force needs to be applied by spring element 17 to always ensure a reliable closure of surface element 13, which is designed as a shutter, at all rotational speeds of printing-machine cylinder 1 but, on the other hand, that surface element 13 can be opened by applying a very small pressure force onto the region of surface element 13 near the folding blade, for example, with the tip of an adjustment tool or wrench.

Spring element 26 is dimensioned such that developing centrifugal forces 20 will not cause the leading edge of hinged segment 13.3 to deflect beyond the position shown in FIG. 3 with respect to the retracted tip of folding device 5.

Using the design approach according to the present invention, on one hand, it is possible to attain a quick access to fastening elements 10 for folding device 5, whether they are folding blades or sets of impaling pins, in interior spaces 28 of copy-carrying cylinders or on other cylinders of folding apparatuses or of rotary printing presses. Besides, it is guaranteed that during the operation of the cylinders designed according to the present invention, the closure of the access openings which are only required for maintenance work is ensured, on one hand, by preloading elements and by centrifugal forces 20 which develop during operation and act upon hinged surface elements 13 formed in one piece and upon hinged segments 13.3 of multipart surface elements. Because of this, a virtually continuous lateral cylinder surface 2 is formed during the operation a of copy-carrying cylinder 1 designed according to the present invention so that clearances in the region surrounding retractable and extensible folding device 5 on copy-carrying cylinders can be effectively closed. Turning down of comers or other impairments of page areas or whip effects occurring during the transfer of folded copies from lateral cylinder surface 2 into open folding jaws on folding jaw cylinders are thus reduced or even obviated.

"Copy" as defined herein includes all printed products, and includes printed products produced by a printing press and includes signatures.

List of Reference Numerals

| | |
|---|---|
| 1 | Cylinder |
| 2 | Lateral cylinder surface |
| 3 | Surface coating |
| 4 | Opening |
| 5 | Folding device |
| 6 | Cover |
| 7 | Swivel axle |
| 8 | Spacer |
| 9 | Folding device receptacle |
| 10 | Clamping screw |
| 11 | Screw head |
| 12 | Guide |
| 13 | Surface element |
| 13.1 | Upper side |
| 13.2 | Lower side |
| 13.3 | Hinged segment |
| 13.4 | Stationary segment |
| 14 | Bearing |
| 15 | Fastening screw |
| 16 | Swivel pin |
| 17 | Spring element |
| 18 | Contact area |
| 19 | Recess |
| 20 | Centrifugal force |
| 21 | Distance |
| 22 | Closed position |
| 23 | Open position |
| 24 | Guide surface |
| 25 | Tool |
| 26 | Tension-compression spring |
| 27 | Articulation point |
| 28 | Interior of cylinder |

What is claimed is:

1. A copy-carrying cylinder comprising:

a folding device;

a peripheral surface for carrying sheet copies, the copies capable of being acted upon by the folding device for producing a fold, the peripheral surface having an opening for the folding device; and a movable surface element being associated with the opening, the movable surface element being arranged near the folding device so that, upon application of a pressure force, the movable surface element is movable into an open position, the movable surface element in the open position enabling access to the folding device, the movable surface element being automatically movable from the open position into a closed position as a result of canceling the pressure force.

2. The copy-carrying cylinder as recited in claim 1 wherein the movable surface element has a one-part or multipart design.

3. The copy-carrying cylinder as recited in claim 2 wherein the movable surface element includes a hinged segment and a stationary segment, and further comprising a spring attached to the hinged segment.

4. The copy-carrying cylinder as recited in claim 1 wherein the movable surface element is accommodated on a wall of the cylinder, the wall bounding the opening in the peripheral surface.

5. The copy-carrying cylinder as recited in claim 4 further comprising a hinge bearing accommodated on the wall of the cylinder, the movable surface element being supported by the hinge bearing.

6. The copy-carrying cylinder as recited in claim 5 wherein the hinge bearing has a swivel pin of the hinge bearing arranged offset from the center of mass of the movable surface element toward the bounding wall of the cylinder in such a manner that the movable surface element is automatically closed by the centrifugal forces produced during a rotation of the cylinder.

7. The copy-carrying cylinder as recited in claim 4 further comprising a spring element, the movable surface element being biased via the spring element.

8. The copy-carrying cylinder as recited in claim 7 wherein the spring element is a spiral spring surrounding a swivel pin.

9. The copy-carrying cylinder as recited in claim 8 wherein free legs of the spiral spring are braced against the hinge bearing or cylinder and against a lower side of the movable surface element.

10. The copy-carrying cylinder as recited in claim 7 wherein the spring element is designed as a tension-compression spring.

11. The copy-carrying cylinder as recited in claim 10 wherein the tension-compression spring is articulated to the hinge bearing or cylinder and to a lower side of the movable surface element.

12. The copy-carrying cylinder as recited in claim 1 wherein a contact area of the movable surface element is capable of moving into the opening of the peripheral surface.

* * * * *